US011486249B2

(12) United States Patent
Zhou et al.

(10) Patent No.: US 11,486,249 B2
(45) Date of Patent: Nov. 1, 2022

(54) COMBINED ROCK-BREAKING TBM TUNNELING METHOD IN COMPLEX STRATA FOR REALIZING THREE-WAY FORCE DETECTION

(71) Applicant: Institute of Rock and Soil Mechanics, Chinese Academy of Sciences, Hubei (CN)

(72) Inventors: Hui Zhou, Hubei (CN); Jingjing Lu, Hubei (CN); Futong Xu, Hubei (CN); Chuanqing Zhang, Hubei (CN); Dawei Hu, Hubei (CN); Yang Gao, Hubei (CN); Fanjie Yang, Hubei (CN); Yong Zhu, Hubei (CN); Mingming Hu, Hubei (CN)

(73) Assignee: INSTITUTE OF ROCK AND SOIL MECHANICS, CAS, Wuhan (CN)

( * ) Notice: Subject to any disclaimer, the term of this patent is extended or adjusted under 35 U.S.C. 154(b) by 169 days.

(21) Appl. No.: 16/919,058

(22) Filed: Jul. 1, 2020

(65) Prior Publication Data

US 2021/0003009 A1 Jan. 7, 2021

(30) Foreign Application Priority Data

Jul. 2, 2019 (CN) ..... 201910587760.X

(51) Int. Cl.
*E21D 9/00* (2006.01)
*E21D 9/10* (2006.01)
(Continued)

(52) U.S. Cl.
CPC ..... *E21D 9/003* (2013.01); *E21D 9/087* (2013.01); *E21D 9/104* (2013.01); *E21D 9/1066* (2013.01); *E21D 9/112* (2013.01); *E21D 9/106* (2013.01)

(58) Field of Classification Search
CPC ..... E21D 9/003; E21D 9/087; E21D 9/10; E21D 9/1006; E21D 9/104; E21D 9/106;
(Continued)

(56) References Cited

U.S. PATENT DOCUMENTS

2008/0024000 A1* 1/2008 Moulin ..... E21D 9/112 299/1.05
2017/0122103 A1* 5/2017 Barwart ..... E21D 9/104
(Continued)

FOREIGN PATENT DOCUMENTS

CN 107577862 A * 1/2018 ..... E21D 9/10
CN 208109307 U 11/2018

*Primary Examiner* — Abby J Flynn
*Assistant Examiner* — Michael A Goodwin
(74) *Attorney, Agent, or Firm* — Syncoda LLC; Feng Ma

(57) ABSTRACT

Disclosed a combined rock-breaking TBM tunneling method in complex strata for realizing three-way force detection, comprising the steps of preparing a combined mechanical-hydraulic rock-breaking cutter head for TBM construction; starting construction; advancing the combined mechanical-hydraulic rock-breaking cutter head; pushing and pressing against a tunnel face by a mechanical cutter tool; subjecting a three-way force detection cutter to squeezing forces; feeding back three-way force data by a three-way force sensor; processing information by a TBM back-end control processor; obtaining a value of rock-cutter contact angle φ; feeding back parameter information to a TBM cutter head control center by a lithology index center; responding by the TBM cutter head control center, obtaining and adjusting parameters by the mechanical cutter tool equipped with the three-way force sensor; and breaking rock by the combined mechanical-hydraulic rock-breaking cutter head. The method disclosed is energy-saving and efficient, and has high rock-breaking efficiency.

10 Claims, 6 Drawing Sheets

(51) Int. Cl.
*E21D 9/087* (2006.01)
*E21D 9/11* (2006.01)

(58) Field of Classification Search
CPC ..... E21D 9/1066; E21D 9/108; E21D 9/11; E21D 9/112; E21C 35/24; E21C 39/00
See application file for complete search history.

(56) References Cited

U.S. PATENT DOCUMENTS

2018/0010437 A1* 1/2018 Reid ..... E21B 44/04
2020/0141237 A1* 5/2020 Lorant ..... E21D 9/108

* cited by examiner

COMBINED ROCK-BREAKING TBM TUNNELING METHOD IN COMPLEX STRATA FOR REALIZING THREE-WAY FORCE DETECTION

TECHNICAL FIELD

The disclosure relates to the technical field of TBM rock breaking, and in particular to a combined rock-breaking TBM tunneling method in complex strata for realizing three-way force detection.

BACKGROUND OF THE INVENTION

With wide applications of full face rock tunnel boring machine (TBM) in tunnel construction projects such as water conservancy projects, subway construction projects, traffic construction projects, etc., higher requirements have been placed on the performance of TBM tunneling device. In recent years, many scientific researchers have begun research on combined TBM rock-breaking based on traditional mechanical TBM rock-breaking.

A suitable penetration should be able to lead to form the largest rock-breaking range with minimum energy consumption and mechanism wear under the condition of certain cutter spacing.

The rock-breaking penetration of traditional mechanical constant cross-section disc cutters is determined by TBM parameters, and will be adjusted for different lithological types of tunnel face; however, because it is difficult to find a suitable TBM penetration during the construction process, it is easy to cause the loss of TBM cutting energy and the wear of the cutter head.

In Chinese Patent CN 103244119 A, entitled "Layout Method and Structure of High-pressure Water Jet in cutter head of tunneling machine", the inventors, Zhang Chunguang, Wei Jing, et al. propose a method for arranging several high-pressure water nozzles based on traditional TBM cutter head main structure for the purpose of improving a rock-breaking efficiency of TBM. With this method, the cutter head is re-arranged by adding a new module (high pressure nozzle) to achieve the purpose of improving the rock-breaking efficiency of TBM; the high pressure water jet nozzles are provided in the front end of a mechanical cutter, that is, hydraulic cutting is first performed and then followed by mechanical rolling; the nozzles are installed in the front end of the cutter. The actual operation of this method is equivalent to cutting a groove with a water cutter first, then applying the mechanical cutter thereafter. This rock-breaking process requires greater pressure.

In Chinese Patent CN105736006A, entitled "Design method for cutter head of high-pressure water jet full face rock tunnel boring machine", the inventors Huo Junzhou, Zhu Dong, et al. optimized the shape of traditional disc cutter heads and uses a layout in the form of two cross-shaped spokes to perform rock-breaking by using impacts of water jets on four spokes and rotary extrusion of the cutter, which reduces energy consumption in rock-breaking. However, in this patent, the form of overall structure of the cutter head is changed greatly, and the feasibility of industrial realization is not high.

Although many new TBMs for combined mechanical-hydraulic rock-breaking have been studied and designed one after another, TBM rock-breaking still faces problems of high energy consumption. If the shape of existing TBM cutter heads is excessively changed, it will be difficult to be achieved under complex construction conditions, and the rock-breaking efficiency needs to be further optimized. At present, the existing and ongoing TBMs are usually suitable for construction under a certain working condition, and cannot be adjusted in real time according to the actual mechanical properties of the excavated stratum during the construction process, thus the problem of "big horse pulling a small cart" often occurs, causing increased TBM energy consumption and tunnel construction cost.

Therefore, there is an urgent need to develop a TBM tunneling method, which can be adjusted in real time according to actual mechanical properties of strata during the construction process, and has lower energy consumption.

SUMMARY OF THE INVENTION

An object of the present disclosure is to provide a combined rock-breaking TBM tunneling method in complex strata for realizing three-way force detection, which has the beneficial effect of energy-saving and higher efficient, higher rock-breaking efficiency and lower cutter head loss rate. In this disclosure, the working state of TBM can be adjusted in real time according to working condition parameters provided by test in an actual working process, so that the TBM can obtain a combination of optimal rock-breaking parameters rendering lower energy consumption and higher rock-breaking efficiency.

In order to achieve the aforementioned object, the present disclosure provides a combined rock-breaking TBM tunneling method in complex strata for realizing three-way force detection, comprising the following steps:

Step 1: preparing a combined mechanical-hydraulic rock-breaking cutter head of a combined rock-breaking tunneling apparatus for TBM construction.

Step 2: starting construction by the combined rock-breaking tunneling apparatus.

Step 3: advancing the combined mechanical-hydraulic rock-breaking cutter head.

Step 4: pushing and pressing against a tunnel face by a mechanical cutter tool.

Step 5: subjecting a three-way force detection cutter to squeezing forces.

Step 6: feeding back three-way force data by a three-way force sensor.

Step 7: processing information by a TBM back-end control processor (such as commercially available DELL PRECISION3551™, I7-10875H™ 16G 256G+1T).

Step 8: obtaining a value of rock-cutter contact angle $\varphi$; feeding back parameter information to a TBM cutter head control center by a lithology index center.

Step 9: responding by the TBM cutter head control center.

Step 10: obtaining and adjusting parameters by the mechanical cutting tools equipped with the three-way force sensor.

Step 11: breaking rock by the combined mechanical-hydraulic rock-breaking cutter head.

In some embodiments, in step 1, the combined mechanical-hydraulic rock-breaking cutter head is installed with a mechanical cutter rock-breaking device, the mechanical cutter rock-breaking device comprises a TBM overall advancement cutter mechanism and a three-way force detection cutter mechanism; the TBM overall advancement cutter mechanism and the three-way force detection cutter mechanism are both arranged radially with respect to the center of the combined mechanical-hydraulic rock-breaking cutter head; the TBM overall advancements cutter mechanisms and the three-way force detection cutter mechanisms are disposed alternately.

In some embodiments, in step 4, the pushing and pressing against a tunnel face by a mechanical cutter tool comprises: the TBM overall advancement cutter mechanisms and the three-way force detection cutter mechanisms perform penetration-cutting on the tunnel face under the action of a hydraulic propulsion cylinder.

In some embodiments, the three-way force detection cutter mechanism comprises a three-way force detection cutter and a three-way force sensor, and the three-way force sensor is provided at a blade edge of the three-way force detection cutter.

In some embodiments, in step 5, the subjecting a three-way force detection cutter to squeezing forces comprises: the three-way force detection cutter contacts and presses against the tunnel face to be squeezed when the TBM works.

In some embodiments, in step 6, the feeding back three-way force data by a three-way force sensor comprises: after subjecting the three-way force detection cutter to squeezing forces in step 5, the three-way force detection sensor obtains a cutter head normal force, a cutter head rolling force, and a cutter head lateral force when the cutter head is working, and feeds back the data to the TBM back-end control processor.

In some embodiments, in step 7, the processing information by a TBM back-end control processor comprises: the TBM back-end control processor is configured to receive real-time three-way force data of the three-way force detection cutter detected by the three-way force sensor. the TBM back-end control processor is also configured to process the data after receiving the three-way force data to obtain a value of a rock-cutter contact angle φ, send the value of a rock-cutter contact angle φ to the back-end lithology index center with the φ value as a search term, and find a corresponding value of rock-cutter contact angle φ for a three-way force detection cutter obtained in a lab from the lithology index center, so as to determine a lithology type in the real-time cutting and breaking of the combined mechanical-hydraulic rock-breaking cutter head, obtain corresponding working condition parameters of the TBM overall advancement cutter mechanism, and send the working condition parameters to the TBM cutter head control center. the value of rock-cutter contact angle φ is calculated in accordance with based on a semi-theoretical and semi-empirical constant cross-section cutter prediction model:

$$NRF_{Rost}=0.5000;$$

$$\varphi=\arctan(FR/FN)\times NRF_{Rost};$$

Wherein, φ represents rock-cutter contact angle in rad;
$NRF_{Rost}$ represents a normalized reasonable predictive value of a resultant force on a cutter;
$CC_{Rost}$ represents a cutter cutting coefficient;
FN and FR represent values of cutter normal force and cutter rolling force, respectively, and the unit thereof is KN.

In some embodiments, in step 8, the lithology index center is an experimental database obtained in rock sample mechanical experiments for instructing TBM cutter thrust and water jet pressure; data of the experimental database comes from rock samples obtained by drilling processes on construction sites, and the experimental database is a database of parameters about optimal water jet pressure and mechanical cutter thrust which are obtained by utilizing a combined rock-breaking comprehensive test bench under the laboratory conditions to simulate rock confining pressure conditions; according to experimental data, the lithology index center returns a set of TBM optimal rock-breaking working condition parameters to the TBM back-end control processor when obtaining a displacement length value of cutter advancement per unit time sent by the TBM back-end control processor, the combined rock-breaking comprehensive test bench adopts the same mechanical cutter and high pressure water jet rock-breaking method as the combined rock-breaking TBM to carry out TBM rock-breaking cutting test under confining pressure conditions.

In some embodiments, the TBM overall advancement cutter mechanism comprises at least a mechanical cutter tool and a high-pressure water jet nozzle structure; the mechanical cutter tool and the high-pressure water jet nozzle structure provided on the combined mechanical-hydraulic rock-breaking cutter head are both circumferentially arranged thereon; the mechanical cutter tool and the high-pressure water jet nozzle structure are arranged in such a way that the high-pressure water jet nozzle structure is provided at a center point of two adjacent mechanical cutter tools; the high-pressure water jet nozzle structure comprises a nozzle, a high-pressure water pipe, an outer spherical supporting mechanism, an inner spherical rotary mechanism, and a pipe steering controller, the outer spherical supporting mechanism is installed and fixed on main body of the combined mechanical-hydraulic rock-breaking cutter head; the inner spherical rotary mechanism is located inside the outer spherical supporting mechanism; the pipe steering controller is arranged between the inner spherical rotary mechanism and the outer spherical supporting mechanism; the high-pressure water pipe passes through the outer spherical supporting mechanism and the inner spherical rotary mechanism sequentially, and extends out of the outer spherical supporting mechanism; the high-pressure water pipe is installed on the inner spherical rotary mechanism; the nozzle is installed at an end of the high-pressure water pipe, and is located outside the outer spherical supporting mechanism.

In some embodiments, the combined rock-breaking tunneling apparatus comprises the combined mechanical-hydraulic rock-breaking cutter head, a rotation driver, a propulsion oil cylinder, a waterjet rotation adjustment part, and the TBM overall advancement cutter mechanism; the TBM overall advancement cutter mechanism is circumferentially arranged on the combined mechanical-hydraulic rock-breaking cutter head; the rotation driver is located at the rear end of the combined mechanical-hydraulic rock-breaking cutter head; the propulsion oil cylinder is located outside an outer frame and at the rear end of the outer frame; the waterjet rotation adjustment part is located in front of the rotation driver: the outer frame is located outside the rotation driver an outer frame upper supporting shoe is located at the back of the outer frame, and the propulsion oil cylinders is fixed on the outer frame and the outer frame upper supporting shoe respectively; a rear support and a water tank are located at the back of the outer frame upper supporting shoe, and the rear support is located between the outer frame upper supporting shoe and the water tank; a waterjet external water pipe is provided on the water tank, and the water tank and the rock-breaking device are connected through the waterjet external water pipe; a transmission conveyor is located inside the outer frame; a bucket is located at a front end of the transmission conveyor a shield and an oil hydraulic cylinder are provided outside the outer frame; and two ends of the oil hydraulic cylinder are respectively connected to an outer wall of the outer frame and an inner wall of the shield.

In some embodiments, the waterjet rotation adjustment part comprises a high-pressure water pipe docking port and a waterjet rotation adjustment part disc; the high-pressure water pipe docking port is located on the waterjet rotation adjustment part disc; an outer periphery of the waterjet rotation adjustment part disc is fixed to an inner wall of the rotation driver; the high-pressure water pipe docking port comprises a high-pressure water pipe docking port front end and a high-pressure water pipe docking port rear end; the high-pressure water pipe docking port rear end is in communication with the waterjet external water pipe; the high-pressure water pipe docking port front end is connected to the high-pressure water pipe; and the waterjet external water pipe is telescopic water pipe.

In some embodiments, in step 9, the TBM cutter head control center responds when it receives the working condition parameters transmitted from the TBM back-end control processor and acts on the mechanical cutter tool and the high-pressure water jet nozzle structure.

In some embodiments, in step 10, lithology determination result obtained by the three-way force detection cutter mechanism and the TBM working condition parameters fed back by the three-way force detection cutter mechanism are finally applied to the TBM overall advancement cutter mechanism adjacent to the three-way force detection cutter mechanism; and the TBM overall advancement cutter mechanism (1.11) starts construction work after obtaining and adjusting the TBM working condition parameters.

The present disclosure has the following advantages:

(1) The embodiments of the present disclosure can be applied to tunneling of strata involving various kinds of lithology. In the method of the present disclosure, the working state of the TBM can be adjusted in real time according to the working condition parameters provided by the test in the actual working process, so that the TBM can obtain an optimal rock-breaking parameter combination with lower energy consumption and higher rock breaking efficiency, thereby reducing construction energy consumption and engineering cost, and overcoming the difficulties of "big horse pulling small cart" during construction according to existing technology.

(2) The embodiments of the present disclosure have the advantages of energy saving, higher efficiency and higher rock breaking efficiency. The embodiments of the present disclosure provide the mechanical cutter rock-breaking device; the hydraulic cutting part (high pressure water jet) of the mechanical cutter rock-breaking device preliminarily cuts grooves in front of the rolling direction of the cutter head; this hydraulic cutting will form grooves with certain width and depth (i.e., hydraulic cutting grooves); during the hydraulic cutting process, the rock on the tunnel face will be initially broken. On that basis, the TBM overall advancement cutter mechanism of the mechanical cutter rock-breaking device will perform rolling and cutting process on the hydraulic cutting grooves; using the TBM overall advancement cutter mechanism, the rock cracks formed by hydraulic cutting grooves can be extended and expanded, and the cracks generated between the adjacent TBM overall advancement cutter mechanisms can intersect; rock blocks between the adjacent TBM overall advancement cutter mechanisms are out into triangular rock slags and ellipse or plate-shaped rock slags; the penetration of the combined mechanical-hydraulic rock-breaking cutter head installed with TBM overall advancement cutter is relatively small during rock-breaking process according to the present disclosure.

(3) According to the present disclosure, in terms of rock breaking sequence, grooving is performed first and then cutting is performed; and in terms of the time of rock breaking, both grooving and cutting are performed simultaneously, which can make the cooling effect better and effectively reduce mechanical wear.

(4) According to the present disclosure, the high-pressure water jet nozzle structure is located in a radial direction relative to the center of rotation of the cutter head, and is provided between two adjacent mechanical cutter tools. In such an arrangement of cutter head, the high-pressure water jet nozzle structures and the mechanical cutter tool are alternately arranged in the radial direction of the cutter head; the mechanical cutter tool is provided between the two adjacent high-pressure water jet nozzles in the radial direction; during rock cutting, the two adjacent high-pressure water jet nozzles cut two hydraulic grooves first and a boss is formed between the two hydraulic grooves, and then the boss is pressed and broken by the mechanical cutter tool. In this way, the rock-breaking efficiency becomes higher, the maximum force applied by the mechanical cutter tool is reduced, and the reaction force on the mechanical cutter tool is reduced accordingly, thereby reducing the wear on the mechanical cutter tool and shortening the rock-breaking time.

(5) On the basis of the existing TBM cutter head, the combined mechanical-hydraulic rock-breaking cutter head provided by the present disclosure can be realized without significant changes, and industrial feasibility of which is high.

BRIEF DESCRIPTION OF THE DRAWINGS

In FIG. 9, FN represents pushing force; FR represents rolling force; e represents contact angle between rock and cutter, G represents rotation direction of a mechanical cutter rock-breaking device.

In FIG. 10, V1 represents a first position of a modular detection cutter device on a combined mechanical-hydraulic rock-breaking cutter head; V2 represents a second position of the modular detection cutter device on the combined mechanical-hydraulic rock-breaking cutter head; V3 represents a third position of the modular detection cutter device on the combined mechanical-hydraulic rock-breaking cutter head; V4 represents a fourth position of the modular detection cutter device on the combined mechanical-hydraulic rock-breaking cutter head; V5 represents a fifth position of the modular detection cutter device on the combined mechanical-hydraulic rock-breaking cutter head; V6 represents a sixth position of the modular detection cutter device on the combined mechanical-hydraulic rock-breaking cutter head; V7 represents a seventh position of the modular detection cutter device on the combined mechanical-hydraulic rock-breaking cutter head; V8 represents an eighth position of the modular detection cutter device on the combined mechanical-hydraulic rock-breaking cutter head. As can be seen from FIG. 10, a TBM overall advancement cutter mechanism and a three-way force detection cutter mechanism are both circumferentially arranged on, and the TBM overall advancement cutter mechanism and the three-way force detection cutter mechanism are arranged alternately in a radial direction.

In FIG. 11, Direction A is a TBM movement direction in the present disclosure; E represents a movement path of the mechanical cutter tool.

In FIG. 12, A represents a first lithological condition stratus; B represents a second lithological condition stratus; C represents a third lithological condition stratus; D represents an unexcavated rock; and E represents a TBM tunneling direction.

Figure 1:
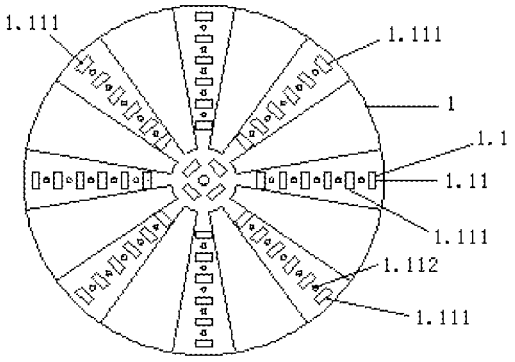
FIG. 1 is a schematic structural diagram of the arrangement structure of a mechanical cutter and a high-pressure water jet nozzle structure on a combined mechanical-hydraulic rock-breaking cutter head according to one or more embodiments of the present disclosure.

Reference Numerals in the Figures are Listed as Below:

1—combined mechanical-hydraulic rock-breaking cutter head; 1.1—mechanical cutter rock-breaking device; 1.11—TBM overall propulsion cutter mechanism; 1.111—mechanical cutter tool; 1.112—high pressure water jet nozzle structure; 1.1121—the nozzle; 1.1122—high-pressure water pipe; 1.1123—outer spherical supporting mechanism; 1.1124—inner spherical rotary mechanism; 1.1125—pipe steering controller; 1.12—three-way force detection cutter mechanism; 1.121—three-way force detection cutter; 1.122—three-way force sensor; 2—rotation driver; 3—propulsion oil cylinder; 3.2— high-pressure water pipe; 4—waterjet rotation adjustment part; 4.1—high-pressure water pipe docking port; 4.11—high-pressure water pipe docking port front end; 4.12—high-pressure water pipe docking port rear end; 4.2—waterjet rotation adjustment part disc; 6—outer frame; 7—outer frame upper supporting shoe; 8—rear support; 9—water tank; 10—waterjet external water pipe; 11—transmission conveyor; 12—bucket; 13—shield; 14—oil hydraulic cylinder; 15—tunnel face; 16—hydraulic groove; 17—combined rock-breaking tunneling apparatusTBM; 18—combined rock-breaking comprehensive test bench; 18.1—sample box capable of applying confining pressure; 18.2—rotation cutter head; 18.21—test bench mechanical cutter tool; 18.22—test bench high-pressure water jet nozzle; 18.3—hydraulic oil cylinder.

DETAILED DESCRIPTION OF THE INVENTION

A better understanding of the features and advantages of the present disclosure will be obtained by reference to the accompanying drawings and embodiments, which are not intended to be in any way limited to the scope of the disclosure as claimed. It will be obvious to those skilled in the art that such the accompanying drawings and embodiments are provided by way of example only.

Figure 6:
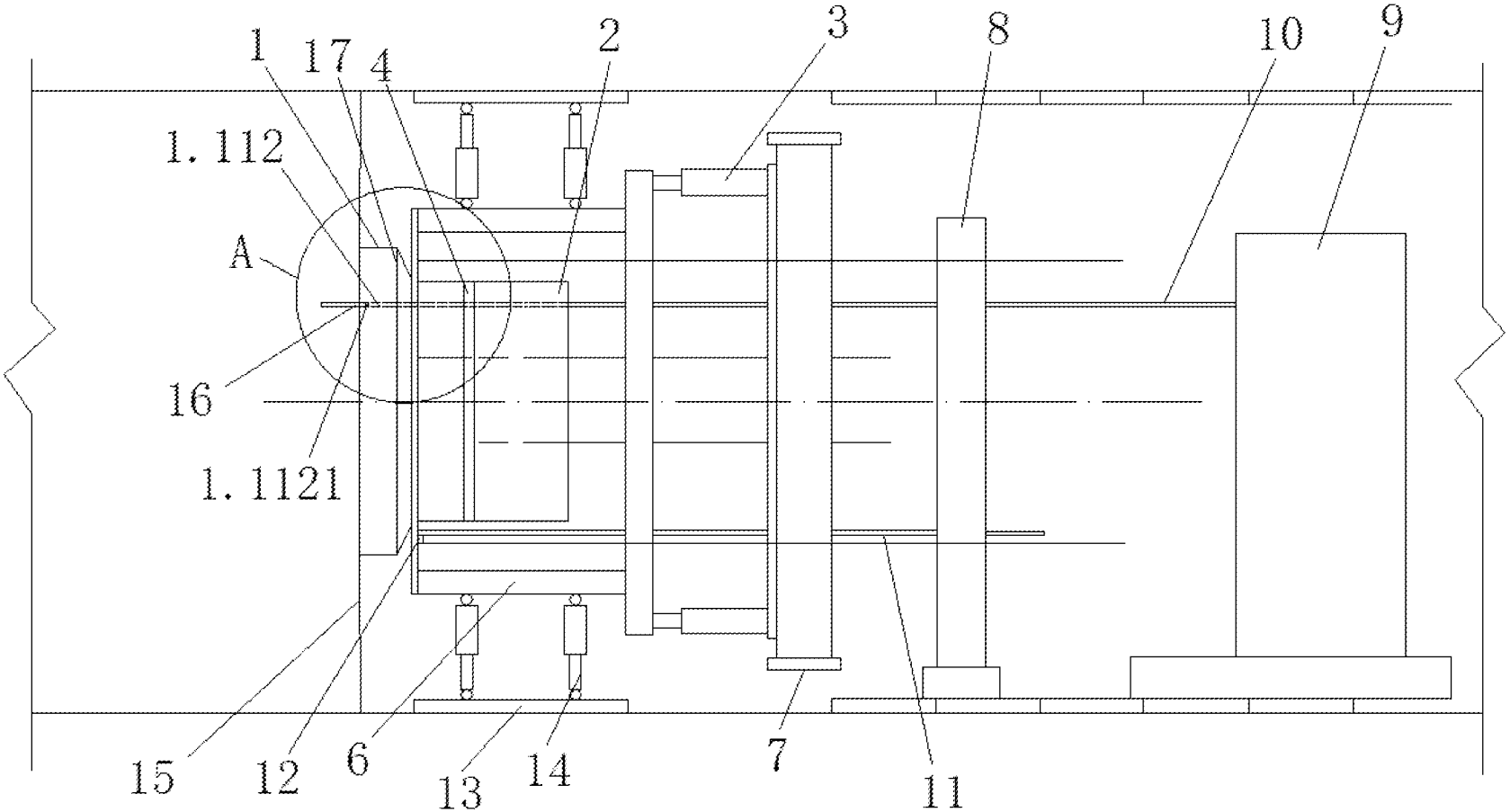
FIG. 6 is a schematic structural diagram of a combined rock-breaking tunneling apparatus of one or more embodiments of the present disclosure.
Figure 14:
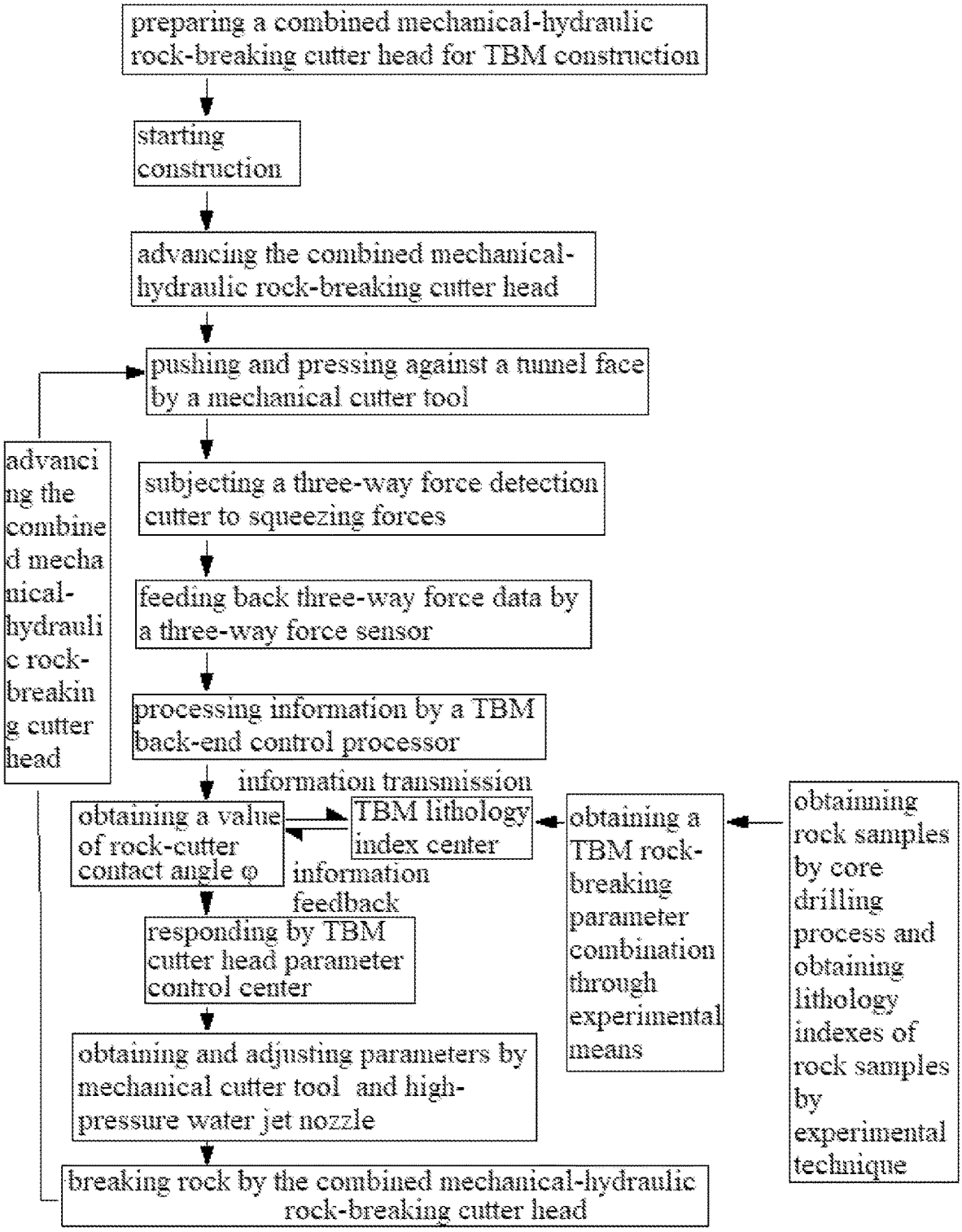
FIG. 14 is a flow chart showing a working process of one or more embodiments of the present disclosure.

As seen from the accompanying drawings, a combined rock-breaking TBM tunneling method in complex strata for realizing three-way force detection is provided, as shown in FIGS. 6 and 14, comprising the following steps:

Step 1: preparing a combined mechanical-hydraulic rock-breaking cutter head of a combined rock-breaking tunneling apparatus 17 for TBM construction.

Step 2: starting construction by the combined rock-breaking tunneling apparatus 17.

Step 3: advancing the combined mechanical-hydraulic rock-breaking cutter head 1.

Step 4: pushing and pressing against a tunnel face 15 by a mechanical cutter tool 1.111.

Step 5: subjecting a three-way force detection cutter to squeezing forces.

Step 6: feeding back three-way force data by a three-way force sensor 1.122.

Step 7: processing information by a TBM back-end control processor.

Step 8: obtaining a value of rock-cutter contact angle φ; feeding back parameter information to a TBM cutter head control center by a lithology index center.

Step 9: responding by the TBM cutter head control center.

Step 10: obtaining and adjusting parameters by a mechanical cutter tool 1.111 equipped with the three-way force sensor.

Step 11: breaking rock by the combined mechanical-hydraulic rock-breaking cutter head 1.

Figure 10:
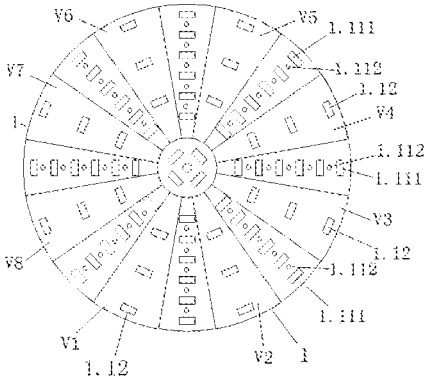
FIG. 10 is a schematic structural diagram showing a layout of a mechanical cutter rock-breaking device on the combined mechanical-hydraulic rock-breaking cutter head of one or more embodiments of the present disclosure.

In some embodiments, in step 1, the combined mechanical-hydraulic rock-breaking cutter head 1 may be installed with a mechanical cutter rock-breaking device 1.1; the mechanical cutter rock-breaking device 1.1 may comprise a TBM overall advancement cutter mechanism 1.11 and a three-way force detection cutter mechanism 1.12; the TBM overall advancement cutter mechanism 1.11 and the three-way force detection cutter mechanism 1.12 are both arranged radially with respect to the center of the combined mechanical-hydraulic rock-breaking cutter head 1; and the TBM overall advancement cutter mechanism 1.11 and the three-way force detection cutter mechanism 1.12 are disposed alternately, as shown in FIG. 10.

In some embodiments, in step 4, the pushing and pressing against a tunnel face 15 by a mechanical cutter tool may comprise: the TBM overall advancement cutter mechanisms 1.11 and the three-way force detection cutter mechanisms 1.12 perform penetration-cutting on the tunnel face 15 under the action of a hydraulic propulsion cylinder.

Figure 8:
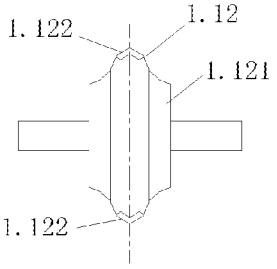
FIG. 8 is a schematic structural diagram of a three-way force detection cutter mechanism of one or more embodiments of the present disclosure.

In some embodiments, the three-way force detection cutter mechanism 1.12 may comprise a three-way force detection cutter 1.121 and a three-way force sensor 1.122, and the three-way force sensor 1.122 may be provided at a blade edge of the three-way force detection cutter 1.121, as shown in FIG. 8. The three-way force detection cutter 1.121 is a mechanical disc cutter.

In some embodiments, in step 5, the subjecting a three-way force detection cutter 1.121 to squeezing forces may comprise: the three-way force detection cutter 1.121 on the combined mechanical-hydraulic rock-breaking cutter head 1 contacts and presses against the tunnel face 15 to be squeezed when the TBM is working. In addition, a blade edge of the three-way force detection cutter 1.121 may be loaded with the three-way force sensor.

Figure 9:
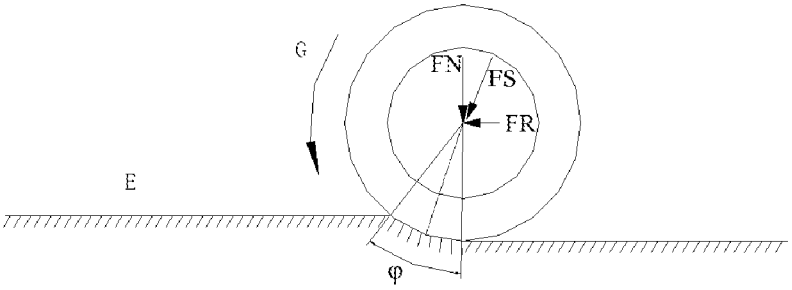
FIG. 9 is a schematic structural diagram showing rock breaking of the mechanical cutter rock-breaking device of one or more embodiments of the present disclosure.

In some embodiments, in step 6, the feeding back three-way force data by a three-way force sensor may comprise: after subjecting the three-way force detection cutter (1.121) to squeezing forces in step 5, the three-way force detection sensor 1.122 loaded at the blade edge of the three-way force detection cutter 1.121 obtains a cutter head normal force FN, a cutter head rolling force FR, and a cutter head lateral force FS when the TBM cutter head is working and feeds back the data to the TBM back-end control processor, as shown in FIG. 9.

In some embodiments, in step 7, the processing information by a TBM back-end control processor comprises: the TBM back-end control processor is configured to receive real-time data of three-way force applied to the three-way force detection cutter and detected by the three-way force sensor 1.122.

In some embodiments, as shown in FIG. 9, the TBM back-end control processor (such as commercially available DELL PRECISION3551™, I7-10875H™ 16G 256G+1T) is configured to process the data of three-way force data after being received to obtain a value of a rock-cutting contact angle φ, send the φ value to a back-end lithology index center (such as using commercially available DELL PRECISION3551™, I7-10875H™ 16G 256G+1T) with the φ value as a search term, and find a corresponding value of rock cutter rock-cutting contact angle φ for a three-way force detection cutter obtained in a lab from the lithology index center (the φ values for different rock-cutting contact angles are different under the same thrust), so as to determine a lithology type in the real-time cutting and breaking of combined mechanical-hydraulic rock-breaking cutter head 1, obtain corresponding working condition parameters for the TBM overall advancement cutter mechanism 1.11, and send the working condition parameters to the TBM cutter head control center (such as using commercially available DELL PRECISION3551™, I7-10875H™ 16G 256G+1T).

The value of rock-cutter contact angle φ can be calculated in accordance with a semi-theoretical and semi-empirical constant cross-section cutter prediction model:

$$NRF_{Rost}=0.5000;$$

$$\varphi=\arctan(FR/FN)\times NRF_{Rost};$$

Wherein, φ represents rock-cutter contact angle in rad;

$NRF_{Rost}$ represents a normalized reasonable predictive value of a resultant force on a cutter (it is typically assumed as 0.5000, that is, a resultant force is at a center position of the arc of the tunnel face before and after cutting);

$CC_{Rost}$ represents a cutter cutting coefficient;

FN and FR represent values of cutter normal force and cutter rolling force, respectively, and the unit thereof is KN.

In some embodiments, in step 8, the lithology index center is an experimental database in rock sample mechanical experiments for instructing TBM cutter thrust and water jet pressure.

The data of the experimental database come from rock samples obtained by geological drilling processes or other processes on construction sites, and the experimental database is a database of parameters such as optimal water jet pressure and mechanical cutter thrust and the like which are obtained by utilizing a combined rock-breaking comprehensive test bench 18 under the laboratory conditions to simulate rock confining pressure conditions.

According to experimental data, the lithology index center may returns a set of TBM optimal rock-breaking working condition parameters to the TBM back-end control processor when obtaining a displacement length value of cutter advancement per unit time sent by the TBM back-end control processor.

Figure 13:
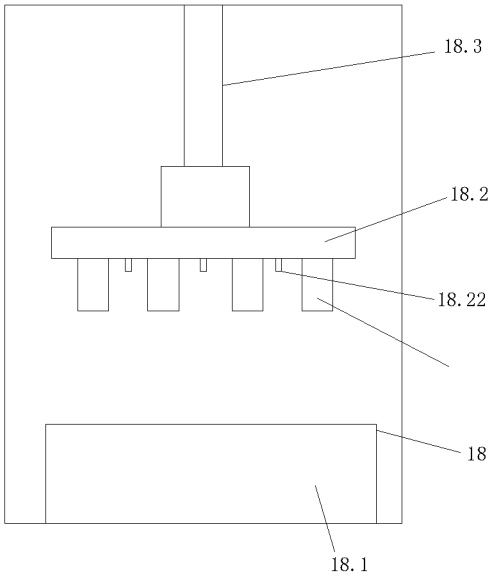
FIG. 13 is a schematic structural diagram of a combined rock-breaking comprehensive test bench of the disclosure.

As shown in FIG. 13, the combined rock-breaking comprehensive test bench 18 may comprise a sample box 18.1 capable of applying confining pressure, a rotation cutter head 18.2 and a hydraulic oil cylinder 18.3. The hydraulic oil cylinder 18.3 is connected to the rotating cutter head 18.2. The rotating cutter head 18.2 is located above the sample box 18.1 capable of applying confining pressure, and is disposed opposite to the sample box 18.1 capable of applying confining pressure. A sample to be tested is placed in the sample box 18.1 capable of applying confining pressure. The sample box 18.1 provides support and confining pressure for the sample to be tested.

There are a test bench mechanical cutter tool 18.21 and a test bench high-pressure water jet nozzle 18.22 provided on the rotating cutter head 18.2 and between the rotating cutter head 18.2 and the sample box 18.1 capable of applying confining pressure.

The test bench mechanical cutter tools 18.21 and the test bench high-pressure water jet nozzles 18.22 are both arranged alternately; a test bench high-pressure water jet nozzle 18.22 is provided between two test bench mechanical cutter tools 18.21.

The test bench high pressure water jet nozzle 18.22 is connected to a water storage device through a connecting water pipe.

The combined rock-breaking comprehensive test bench 18 is a comprehensive test bench serving for researching combined rock-breaking mechanical mechanism and TBM tunneling parameter optimization under laboratory conditions. The test bench mechanical cutter tools 18.21 and the test bench high-pressure water jet nozzles 18.22 on the combined rock-breaking comprehensive test bench 18 may adopt the same mechanical cutter tool 1.111 and high-pressure water jet nozzle structure 1.112 as the combined rock-breaking TBM of the present disclosure, and can perform TBM rock-breaking cutting tests under confining pressure conditions.

In some embodiments, the TBM overall advancement cutter mechanism 1.11 may comprise a mechanical cutter tool 1.111 and a high-pressure water jet nozzle structure 1.112.

When performing rock-breaking, the TBM overall advancement cutter mechanism 1.11 first uses its high-pressure water jet portion to cut grooves to cause initial fractures in the tunnel face rock, so as to form the hydraulic grooves 16, and then uses its mechanical cutter portion to roll and press on the hydraulic grooves, thereby achieving a greater degree of rock breaking purpose.

The mechanical cutter tool 1.111 and the high-pressure water jet nozzle structure 1.112 provided on the combined mechanical-hydraulic rock-breaking cutter head 1 are both arranged circumferentially. When the high-pressure water jet nozzles start working, the water jets can be set according to program. The high-pressure water jet nozzles can work in advance or synchronously with the mechanical cutter tool 1.111 for a combined rock-breaking purpose.

The mechanical cutter tool 1.111 and the high-pressure water jet nozzle structure 1.112 are arranged in such a way that the high-pressure water jet nozzle structure 1.112 is provided at a center point of two adjacent mechanical cutter tools 1.111, as shown in FIGS. 1 and 10.

The high-pressure water jet nozzle structure 1.112 may comprise a nozzle 1.1121, a high-pressure water pipe 1.1122, an outer spherical supporting mechanism 1.1123, an inner spherical rotary mechanism 1.1124, and a pipe steering controller 1.1125.

The outer spherical supporting mechanism 1.1123 is installed and fixed on the main body of the combined mechanical-hydraulic rock-breaking cutter head 1, and the outer spherical supporting mechanism 1.1123 serves as a frame to support the inner spherical rotary mechanism 1.1124.

The inner spherical rotary mechanism 1.1124 is located inside the outer spherical supporting mechanism 1.1123, and the inner spherical rotary mechanism 1.1124 can rotate relative to the outer spherical supporting mechanism 1.1123, and is controlled to rotate by the pipe steering controller.

The pipe steering controller 1.1125 is arranged between the inner spherical rotary mechanism 1.1124 and the outer spherical supporting mechanism 1.1123. The pipe steering controller can detect a spraying angle of the high-pressure water jet nozzle, and can receive external commands to drive the high-pressure water jet nozzle to rotate toward the spraying direction by pushing the inner spherical rotary mechanism 1.1124. The high-pressure water jet nozzle and the pipe are installed in the inner spherical rotary mechanism 1.1124, and the spraying angle is adjusted by the pipe steering controller.

The high-pressure water pipe 1.1122 passes through the outer spherical supporting mechanism 1.1123 and the inner spherical rotary mechanism 1.1124 sequentially, and extends out of the outer spherical supporting mechanism 1.1123. The high-pressure water pipe 1.1122 is installed on the inner spherical rotary mechanism 1.1124. The inner spherical rotary mechanism 1.1124 is configured to support the high-pressure water pipe 1.1122 and the nozzle 1.1121.

Figure 2:
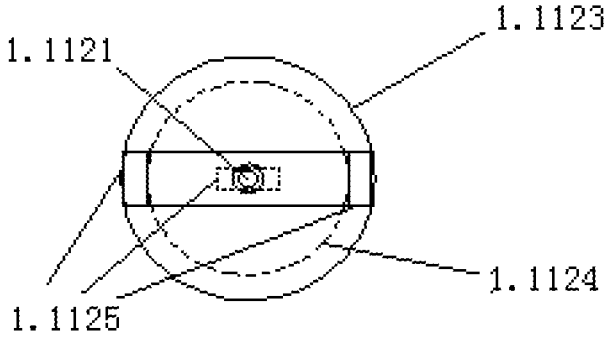
FIG. 2 is a schematic structural top view of a high-pressure water jet nozzle of one or more embodiments of the present disclosure.
Figure 3:
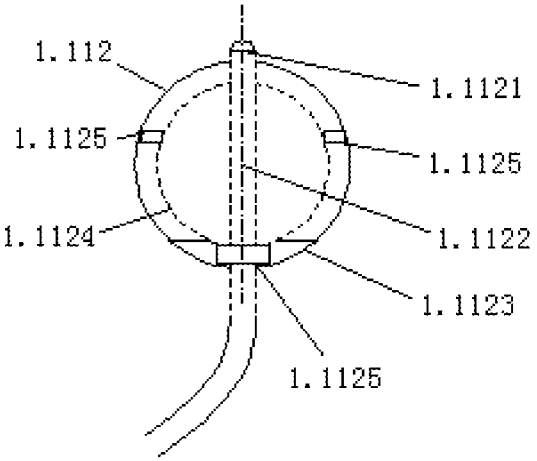
FIG. 3 is a schematic structural front view of a high-pressure water jet nozzle of one or more embodiments of the present disclosure.

The nozzle 1.1121 is installed at an end of the high-pressure water pipe 1.1122, and is located outside the outer spherical supporting mechanism 1.1123, for spraying high-pressure water, as shown in FIGS. 2 and 3.

In some embodiments, the combined rock-breaking tunneling apparatus 17 comprises a combined mechanical-hydraulic rock-breaking cutter head 1, a rotation driver 2, a propulsion oil cylinder 3, a waterjet rotation adjustment part 4 and a TBM overall advancement cutter mechanism 1.11.

The TBM overall advancement cutter mechanism 1.11 is circumferentially arranged on the combined mechanical-hydraulic rock-breaking cutter head 1.

The rotation driver 2 is located at the rear end of the combined mechanical-hydraulic rock-breaking cutter head 1. The rotation driver 2 drives the combined mechanical-hydraulic rock-breaking cutter head 1, the waterjet rotation adjustment part 4, and the waterjet external water pipe, to rotate and tunnel synchronously.

The propulsion cylinder 3 is located outside an outer frame 6 and at the rear end of the outer frame 6 for propelling the TBM.

The waterjet rotation adjustment part 4 is located in front of the rotation driver 2 and is coaxial with the rotation driver 2. A water tank 9 located on the paved track at the rear end of the TBM is in communication with the waterjet external water pipe to supply water to the high pressure water jet nozzle structure. The water tank 9 can guarantee the supply of water.

The outer frame 6 is located outside the rotation driver 2.

An outer frame upper supporting shoe 7 is located at the back of the outer frame 6. The propulsion cylinder 3 is fixed on the outer frame 6 and the outer frame upper supporting shoe 7 respectively. The outer frame upper supporting shoe 7 is configured to brace the cave wall of the surrounding rock to fix the TBM frame.

A rear support 8 and a water tank 9 are located at the back of the outer frame upper supporting shoe 7. The rear support 8 is located between the outer frame upper supporting shoe 7 and the water tank 9. The rear support 8 is configured to support the combined rock-breaking TBM for easy tunneling.

The water tank 9 is provided with a waterjet external water pipe connected to the high-pressure water pipe 3.2. The water tank 9 can provide high-pressure water for hydraulic cutting, and can control the flow rate of high-pressure water by adjusting water pressure of the high-pressure water.

A waterjet external water pipe 10 is provided on a water tank 9. The water tank 9 and the rock-breaking device 1.1 are connected through the waterjet external water pipe 10 and the waterjet rotating adjustment part 4. The waterjet external water pipe realizes the synchronous rotation with the TBM cutter through the docking of the waterjet rotation adjustment part 4. A high pressure water pipe docking port of the waterjet rotation adjustment part 4 is a connection structure between external high pressure water and rock-breaking high-pressure water. The high-pressure water pipe docking port and the waterjet on the combined mechanical-hydraulic rock-breaking cutter head 1 have one-to-one corresponding positions. The waterjet rotation adjustment part 4 rotates synchronously with the combined mechanical-hydraulic rock-breaking cutter head 1. When the TBM works, the waterjet external water pipe is docked with the waterjet rotation adjustment part 4 to realize its synchronous rotation with the TBM cutter head.

A transmission conveyor 11 is located inside the outer frame 6; a bucket 12 is located at the front end of the transmission conveyor 11 and is configured to scoop up rock slags broken by the cutter head, and the rock slags is transported outside the tunnel by the transmission conveyor 11.

Figure 7:
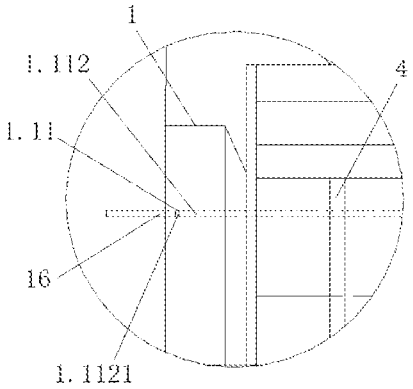
FIG. 7 is an enlarged view at "A" part in FIG. 6.

A shield 13 and an oil hydraulic cylinder 14 are provided outside the outer frame 6; and two ends of the oil hydraulic cylinder 14 are respectively connected to the outer wall of the outer frame 6 and the inner wall of the shield 13, as shown in FIGS. 6 and 7.

In some embodiments, the waterjet rotation adjustment part 4 comprises a high-pressure water pipe docking port 4.1 and a waterjet rotation adjustment part disc 4.2.

The high-pressure water pipe docking port 4.1 is located on the waterjet rotation adjustment part disc 4.2. An outer periphery of the waterjet rotation adjustment part disc 4.2 is fixed to an inner wall of the rotation driver 2.

The high-pressure water pipe docking port 4.1 comprises a high-pressure water pipe docking port front end 4.11 and a high-pressure water pipe docking port rear end 4.12.

The high-pressure water pipe docking port rear end 4.12 is in communication with the waterjet external water pipe 10.

Figure 4:
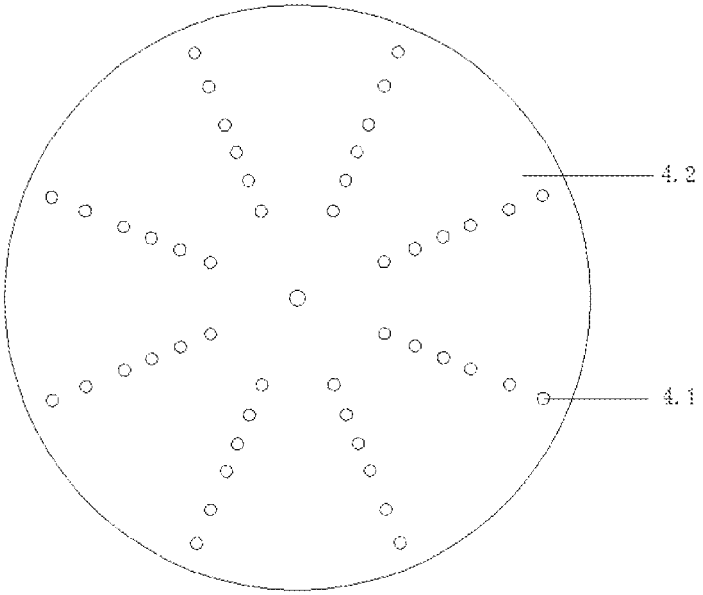
FIG. 4 is a schematic structural diagram of a waterjet rotation adjustment part of the present disclosure.
Figure 5:
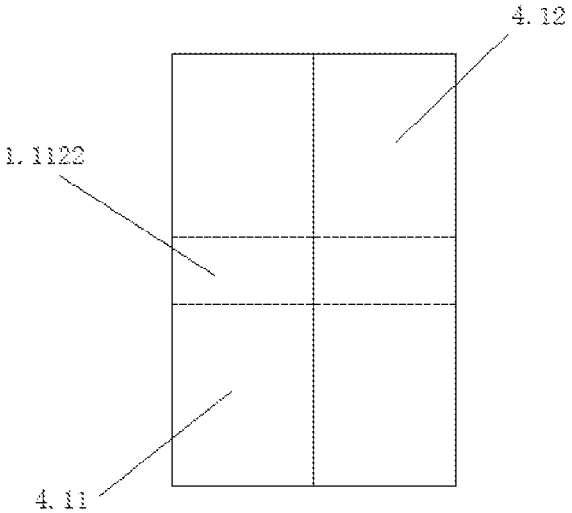
FIG. 5 is a schematic structural diagram of operation of a high-pressure water pipe docking port of one or more embodiments of the present disclosure.

The high-pressure water pipe docking port front end 4.11 is connected to the high-pressure water pipe 1.1122, as shown in FIGS. 4 and 5. The high-pressure water pipe docking port is a connection structure between external high-pressure water and rock-breaking high-pressure water. The high pressure water pipe docking port and the waterjet on the combined mechanical-hydraulic rock-breaking cutter head 1 have one-to-one corresponding positions. When the TBM works, the waterjet external water pipe is docked with the waterjet rotation adjustment part 4 to realize its synchronous rotation with the TBM cutter head.

The waterjet external water pipe 10 is a telescopic water pipe. The waterjet rotation adjustment part 4 is supplied with water from the water tank 9 through the waterjet external water pipe 10, and the waterjet external water pipe 10 can freely adjust the length of the water pipe as the TBM performs tunneling, so as to meet the construction requirements.

In some embodiments, in step 9, specifically, the TBM cutter head control center responds when it receives the working condition parameters transmitted from the TBM back-end control processor and actually acts on the mechanical cutter tool 1.111 and the high-pressure water jet nozzle structure 1.112.

Figure 11:
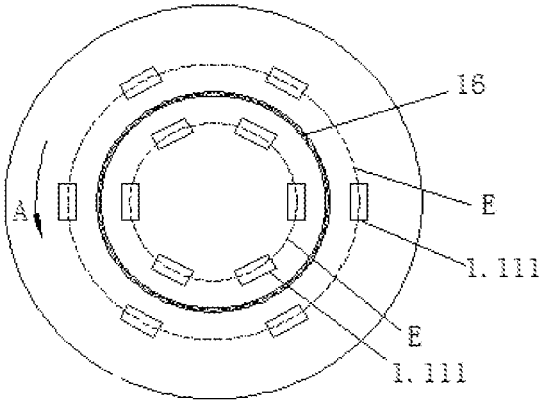
FIG. 11 is a schematic diagram showing a rock breaking process of one or more embodiments of the present disclosure.

In some embodiments, when performing rock-breaking, the TBM overall advancement cutter mechanism 1.11 first uses its high-pressure water jet nozzle structure 1.112 to cut grooves to cause initial fractures in the tunnel face rock, so as to form the hydraulic cutting grooves 16; and then the mechanical cutter tools 1.111 roll and press on bosses between two hydraulic cutting grooves 16 arranged alternately (as shown in FIG. 11) to achieve a purpose of greater degree of rock breaking, improve rock breaking efficiency, and reduce wear.

The combined mechanical-hydraulic rock-breaking cutter head 1 is centered on the cutter head, and the TBM overall advancement cutter mechanisms 1.11 and the three-way force detection cutter mechanisms 1.12 are radially arranged on the cutter head alternately. The number of the three-way force detection cutter mechanisms 1.12 is less (as shown in FIG. 1, FIG. 10).

Figure 12:
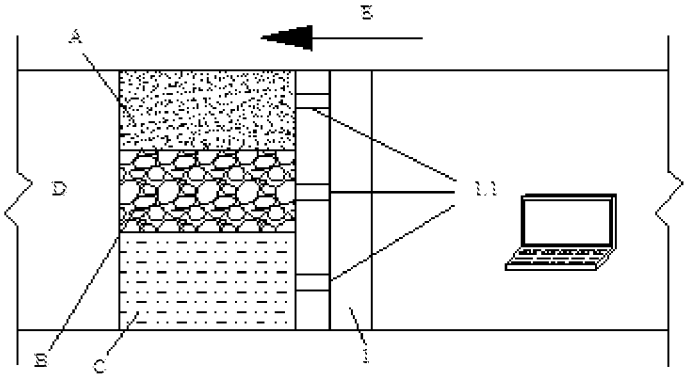
FIG. 12 is a schematic diagram showing a different working structure under different working condition in example 2 of the present disclosure.

In some embodiments, in step 10, the lithology determination result obtained by the three-way force detection cutter mechanism 1.12 and the TBM working condition parameters fed back by the three-way force detection cutter mechanism 1.12 finally act on the TBM overall advancement cutter mechanism 1.11 adjacent to the three-way force detection cutter mechanism 1.12, so that different mechanical cutters all have optimal working condition parameters when the same cutter head is driven in complex geological conditions, thereby achieving an optimal rock breaking effect. As shown in FIGS. 12. A, B, C respectively represent mechanical cutter operations under three different working conditions.

The TBM overall advancement cutter mechanism 1.11 starts construction work after obtaining and adjusting the parameters.

In order to be able to more clearly explain the advantages of the combined rock-breaking TBM tunneling method in complex strata for realizing three-way force detection according to the present disclosure compared with the prior art (involving a mechanical rock-breaking method or a combined rock-breaking method in which the high-pressure water jet nozzles and the mechanical cutters are combined in a simple way on the TBM cutter head), these two technical solutions are compared, and the comparison results are as follows:

| | | rock-breaking efficiency | rock-breaking energy consumption | cutter head loss rate |
|---|---|---|---|---|
| TBM tunneling method in the prior art | Mechanical rock-breaking tunneling method | low | high | high |
| | a combined rock-breaking tunneling method in which the high pressure water jet nozzles and the mechanical cutters are combined in a simple way on the TBM cutter head of the prior art | High (about 30% higher than mechanical rock-breaking method) | Low (about 30% lower than mechanical rock-breaking method) | Low (about 30% lower than mechanical rock-breaking method) |
| | Lithological condition real-time sensing system and method for existing TBM | no existing rock-breaking technique involving sensing and feedback in the process of tunneling in complex strata has been found | | |
| The combined rock-breaking TBM tunneling method in complex strata for realizing three-way force detection according to the present disclosure | | High (about 50%-80% higher than mechanical rock-breaking method) | Low (about 50%-80% lower than mechanical rock-breaking method) | Low (about 30%-50% lower than mechanical rock breaking method) |

As can be seen from the table above, the combined rock-breaking TBM tunneling method in complex strata for realizing three-way force detection according to the present disclosure has higher rock breaking efficiency, lower rock breaking energy consumption and lower cutter head loss rate compared with the prior art (involving a mechanical rock-breaking method or a combined rock-breaking method in which the high pressure water jet nozzles and the mechanical cutters are combined in a simple way on the TBM cutter head).

Example 1

Now taking a white-sand rock sample with a size of 150 mm×150 mm×100 mm as an example, a penetration test is carried out on the white-sand rock sample (TBM cutter rock-breaking mainly involves normal force).

A penetration test on the white-sand rock sample is carried out by a mechanical cutter according to prior art, and the maximum force required for breaking the white-sand rock sample reaches 140 KN.

A penetration test on the white-sand rock sample is carried out by the combined rock-breaking TBM tunneling method in complex strata for realizing three-way force detection according to the present disclosure, in which the white-sand rock sample is firstly subjected to a process of waterjet pre-cutting to form cutting grooves, and then a cutter penetration test is performed. The maximum force required for breaking the white-sand rock sample is only 40 KN, and the rock breaking force is reduced by more than 70%; the time taken for the white-sand rock sample to be broken is much shorter after the white-sand rock sample is subjected to waterjet pre-cutting process. Therefore, the rock breaking efficiency of the method according to the present disclosure is higher. Similarly, because the maximum force applied by the mechanical cutters of the combined rock breaking TBM tunneling method in complex strata for realizing three-way force detection according to the present disclosure is reduced, an inverse force suffered by the cutter tool is correspondingly reduced, and the wear on the cutter tool is reduced accordingly. Therefore, with the method of the present disclosure, the rock breaking process can be carried out in a faster speed.

With the method of present disclosure, after the white-sand rock sample being initially damaged by waterjet cutting, cracks in the white-sand rock sample have already occurred. At this time the force required for cutter cutting will be reduced, so the rock breaking time is shortened, and the difficulties encountered in rock-breaking are relatively low.

Example 2

The present disclosure will be described in detail by taking a tunnel construction of Metro Line No. 2 somewhere as an example. Various embodiments of the present disclosure also provide guidance for tunnel construction and underground engineering construction at other places.

As shown in FIGS. 9, 12, and 14, the tunnel construction of a section of Metro Line No. 2 was carried out by using the combined rock-breaking TBM tunneling method in complex strata for realizing three-way force detection according to the present disclosure, comprising the following steps: first, a rock sample of the tunnel to be constructed in Metro Line No. 2 was obtained with a sampling device. The section of Metro Line No. 2 to be constructed mainly includes three types of rocks (complex strata: including rock types A, B, and C, as shown in FIG. 12); according to the geological information such as the confining pressure of the sampled sample at the site of the section to be constructed, the TBM optimal rock-breaking condition parameters for different rock types in the section to be constructed were obtained on the combined rock-breaking test bench, and then a corresponding database was established. This database was integrated and stored in a lithology index center.

For the construction section of Metro Line No. 2, the TBM optimal rock-breaking condition parameters database retrieval information acquisition method is as below: after a mechanical cutter loaded with a three-way force sensor is pushed and pressed, the three-way force detection sensor obtains a cutter head normal force FN, a cutter head rolling force FR and a cutter head lateral force FS (as shown in FIG. 9) when the TBM cutter head is working. The three-way force sensor feeds back the three-way force data and obtains corresponding values of rock-cutter contact angle φ to assist the TBM to determine the type of rock being cut during its travel, and test and get a combination of optimal rock-breaking parameters for the mechanical cutter tool and high-pressure water jet nozzle in a combined mechanical-hydraulic rock breaking process for different propulsion states. Based on the combination of optimal rock-breaking parameters, the optimal working condition parameters of TBM are established, and a corresponding index relation between the lithology index center and the TBM back-end control processor is established.

The method may include Step 1: preparing a combined mechanical-hydraulic rock-breaking cutter head for TBM construction. Preparation work before TBM construction is conducted such as pre-construction check. Normal operation of all mechanisms of TBM can ensure a smooth excavation of TBM.

The method may further include Step 2: starting construction. TBM starts to work and the cutter head advances.

The method may further include Step 3: the combined mechanical-hydraulic rock-breaking cutter head 1 advances.

The method may further include Step 4: the mechanical cutter tool pushes and presses against a tunnel face. The mechanical cutter tools of the three-way force sensor 1.122 on the TBM cutter head perform penetration-cutting on the tunnel face under the action of a hydraulic propulsion cylinder.

The method may further include Step 5: the three-way force detection cutter is pushed and pressed. During the construction of Metro Line No. 2, the three-way force detection cutter 1.121 of a three-way force detection cutter mechanism 1.12 loaded on the combined mechanical-hydraulic rock-breaking cutter head 1 contacts the tunnel face 15 and is pushed and pressed.

The method may further include Step 6: the three-way force sensor 1.122 feeds back the three-way force data. After the three-way force detection cutter 1.121 of the three-way force detection cutter mechanism 1.12 is pushed and pressed, the three-way force sensor 1.122 obtains a cutter head normal force FN, a cutter head rolling force FR, and a cutter head lateral force FS when the TBM cutter head is working. When the three-way force detection cutter 1.121 equipped with the three-way force sensor 1.122 rolls and press on the A-type rock, the three-way force (the cutter head normal force FN, the cutter head rolling force FR, and the cutter head lateral force FS) corresponding to the A-type rock is fed back. Among them, the cutter head normal force FN and the cuter head rolling force FR are effective.

The method may further include Step 7: information is processed by TBM back-end control processor. The TBM back-end control processor receives the three-way force data fed back by the three-way force sensor 1.122 and obtains the corresponding values of rock-cutter contact angle φ for the A type rock. Then the TBM back-end control processor sends the values of rock-cutter contact angle φ to the backstage lithology index center, obtains the corresponding working condition parameters for the TBM mechanical cutters 1.111 and the high-pressure water jet nozzle structure 1.112 from the lithology index center, and sends these working condition parameters to a TBM cutter head control center.

The method may further include Step 8: the values of rock-cutter contact angle φ is obtained.

The method may further include Step 9: the TBM cutter head control center responds. The TBM cutter head control center can respond upon receiving working condition parameters transmitted by the TBM back-end control processor, and can actually act on the mechanical cutter 1.111 and the high-pressure water jet nozzle structure 1.1121 on the cutter head.

The method may further include Step 10: the mechanical cutter tool and the high-pressure water jet obtain and adjust parameters. The mechanical cutter tool 1.111 and the nozzle 1.1121 of the high-pressure water jet nozzle structure 1.112 obtain the optimal rock breaking parameter combination and make corresponding adjustments, and operate under corresponding optimal working conditions for different stratus lithological conditions. Then combined mechanical-hydraulic rock-breaking cutter head 1 advances the construction. Through the three-way force detection cutter 1.121 equipped with a three-way force sensor 1.122, the parameters are obtained and the type of rock is determined as type A. Then the back-end TBM cutter head control center feeds back the optimal rock-breaking parameter combination obtained by the mechanical cutter tools 1.111 and the nozzles 1.1121 of the high-pressure water jet nozzle structure 1.112 to a corresponding same mechanical cutter tool 1.111 and the high-pressure water jet nozzles on a side of the cutter. Finally, the operations under corresponding optimal working conditions for the type a rock are carried out. This entire process is completed in a very short time. In this way, when the tunnel face 15 of the tunnel (the tunnel face being driven) faces different types of rock during the tunneling operation, the rock type can be determined by retrieving the value of rock-cutter contact angle φ so that each TBM overall advancement cutter mechanism 1.11 equipped with a three-way force sensor 1.122 can perform TBM rock-breaking under local optimal working conditions.

The method may further include Step 11: the combined mechanical-hydraulic rock-breaking cutter head 1 breaks rock. After the cutting and crushing operations are completed, the combined mechanical-hydraulic rock-breaking cutter head 1 continues to advance and enters a new round of work cycle until a corresponding termination command is obtained.

Conclusion: by adopting the combined rock-breaking TBM tunneling method in complex strata for realizing three-way force detection according to the present disclosure during the construction of the certain section of Metro Line No. 2, the beneficial effects of energy saving and higher rock-breaking efficiency can be achieved. Furthermore, during actual work in the process of tunneling by TBM, the working state of the TBM can be adjusted in real time according to the working condition parameters provided by experiments, so that the TBM can obtain an optimal rock breaking parameter combination with low energy consumption and high rock breaking efficiency.

Other unexplained parts belong to the prior art.

The invention claimed is:

1. A combined rock-breaking Tunnel Boring Machine (TBM) tunneling method in complex strata for realizing three-way force detection, comprising:

Step 1: preparing a combined mechanical-hydraulic rock-breaking cutter head (1) of a combined rock-breaking TBM (17) for construction;

Step 2: starting construction by the combined rock-breaking TBM (17);

Step 3: propelling the combined mechanical-hydraulic rock-breaking cutter head (1);

Step 4: pushing and pressing mechanical cutter tools (1.111) against a tunnel face (15);

Step 5: subjecting three-way force detection cutters to squeezing forces and three-way force sensors (1.122) obtaining three-way force data, wherein the three-way force detection cutters are loaded with the three-way force sensors;

Step 6: sending the three-way force data from the three-way force sensors (1.122) to a TBM back-end control processor;

Step 7: processing the three-way force data by the TBM back-end control processor;

Step 8: obtaining a value of a rock-cutting contact angle φ from said processing the three-way force data; obtaining parameter information from a lithology index center based on the value of the rock-cutting contact angle φ; sending the parameter information to a TBM cutter head control center;

Step 9: the TBM cutter head control center responding to the parameter information;

Step 10: obtaining the parameter information at the mechanical cutter tools (1.111) and adjusting the mechanical cutter tools (1.111) based on the obtained parameter information; and Step 11: breaking rock by the combined mechanical-hydraulic rock-breaking cutter head (1).

2. The method of claim 1, wherein in step 1, the combined mechanical-hydraulic rock-breaking cutter head (1) is installed with a mechanical cutter rock-breaking device (1.1);

the mechanical cutter rock-breaking device (1.1) comprises TBM propulsion cutter mechanisms (1.11) and three-way force detection cutter mechanisms (1.12); and the three-way force detection cutter mechanisms (1.12) comprise the three-way force detection cutters (1.121);

the TBM propulsion cutter mechanisms (1.11) and the three-way force detection cutter mechanisms (1.12) are both arranged in a radial direction of the combined mechanical-hydraulic rock-breaking cutter head (1) with respect to the center of the combined mechanical-hydraulic rock-breaking cutter head (1); and the TBM propulsion cutter mechanisms (1.11) and the three-way force detection cutter mechanisms (1.12) are arranged alternately;

in step 4, the pushing and pressing the mechanical cutter tools (1.111) and the three-way force detection cutters against the tunnel face (15) comprises: the TBM propulsion cutter mechanisms (1.11) and the three-way force detection cutter mechanisms (1.12) perform penetration-cutting on the tunnel face (15) under the action of hydraulic propulsion cylinders.

3. The method of claim 2, wherein the three-way force sensors (1.122) are provided at blade edges of the three-way force detection cutters (1.121);

wherein in step 5, the subjecting the three-way force detection cutters (1.121) to squeezing forces comprises: the three-way force detection cutters (1.121) contacts and press against the tunnel face (15) to be squeezed when the TBM works.

4. The method of claim 3, wherein in step 6, the sending the three-way force data by the three way force sensors comprises: after subjecting the three-way force detection cutters (1.121) to squeezing forces in step 5, the three-way force sensors (1.122) obtaining a cutter head normal force, a cutter head rolling force, and a cutter head lateral force when the TBM cutter head is working, and sending the three-way force data to the TBM back-end control processor.

5. The method of claim 4, wherein in step 7, the processing the three-way force data by the TBM back-end control processor comprises: the TBM back-end control processor is configured to receive real-time three-way force data of the three-way force detection cutters detected by the three-way force sensors (1.122);

the TBM back-end control processor is configured to process the three-way force data after being received to obtain the value of the rock-cutting contact angle φ, send the φ value to the lithology index center with the value of the rock-cutting contact angle φ as a search term, and find a corresponding value of rock cutter the rock-cutting contact angle φ for a three-way force detection cutter obtained in a lab from the lithology index center, so as to determine a lithology type in a real-time cutting and breaking of the combined mechanical-hydraulic rock-breaking cutter head (1), obtain corresponding working condition parameters of the TBM propulsion cutter mechanisms (1.11) from the parameter information, and send the obtained corresponding working condition parameters to the TBM cutter head control center;

the value of the rock-cutting contact angle φ is calculated in accordance with a semi-theoretical and semi-empirical constant cross-section cutter prediction model:

$$NRF_{Rost}=0.5000;$$

$$\varphi=\arctan(FR/FN)\times NRF_{Rost};$$

wherein, φ represents rock cutter the rock-cutting contact angle in rad;

$NRF_{Rost}$ represents a normalized reasonable predictive value of a resultant force on a cutter;

FN and FR represent values of cutter normal force and cutter rolling force, respectively, and the unit thereof is KN.

6. The method of claim 5, wherein:

in step 8, the lithology index center is an experimental database obtained in rock sample mechanical experiments;

the experimental database is constructed based on rock samples obtained by drilling processes on construction sites; and the experimental database is a database of parameters about optimal water jet pressure and mechanical cutter thrust obtained by utilizing a combined rock-breaking comprehensive test bench under laboratory conditions to simulate rock confining pressure conditions;

the method further comprising: sending, from the lithology index center a set of TBM optimal rock-breaking working condition parameters of the parameter information to the TBM back-end control processor when obtaining a displacement length value of cutter propulsion per unit time sent by the TBM back-end control processor.

7. The method of claim 6, wherein the TBM propulsion cutter mechanisms (1.11) further comprise at least the mechanical cutter tools (1.111) and high-pressure water jet nozzle structures (1.112);

the mechanical cutter tools (1.111) and the high-pressure water jet nozzle structures (1.112) provided on the combined mechanical-hydraulic rock-breaking cutter head (1) are both circumferentially arranged thereon;

the mechanical cutter tools (1.111) and the high-pressure water jet nozzle structures (1.112) are arranged in such a way that the high-pressure water jet nozzle structures (1.112) are provided at center points of two adjacent mechanical cutter tools (1.111);

each of the high-pressure water jet nozzle structures (1.112) comprises a nozzle (1.1121), a high-pressure water pipe (1.1122), an outer spherical supporting mechanism (1.1123), an inner spherical rotary mechanism (1.1124), and a pipe steering controller (1.1125);

the outer spherical supporting mechanism (1.1123) is installed and fixed on a main body of the combined mechanical-hydraulic rock-breaking cutter head (1);

the inner spherical rotary mechanism (1.1124) is located inside the outer spherical supporting mechanism (1.1123);

the pipe steering controller (1.1125) is arranged between the inner spherical rotary mechanism (1.1124) and the outer spherical supporting mechanism (1.1123);

the high-pressure water pipe (1.1122) passes through the outer spherical supporting mechanism (1.1123) and the inner spherical rotary mechanism (1.1124) sequentially, and extends out of the outer spherical supporting mechanism (1.1123);

the high-pressure water pipe (1.1122) is installed on the inner spherical rotary mechanism (1.1124); and the nozzle (1.1121) is installed at an end of the high-pressure water pipe (1.1122), and is located outside the outer spherical supporting mechanism (1.1123).

8. The method of claim 7, wherein the combined rock-breaking TBM (17) further comprises a rotation driver (2), propulsion oil cylinders (3), a waterjet rotation adjustment part (4), and the TBM propulsion cutter mechanisms (1.11);

the TBM propulsion cutter mechanisms (1.11) are circumferentially arranged on the combined mechanical-hydraulic rock-breaking cutter head (1);

the rotation driver (2) is located at a rear end of the combined mechanical-hydraulic rock-breaking cutter head (1);

the propulsion oil cylinders (3) are located outside an outer frame (6), and located at a rear end of the outer frame (6);

the waterjet rotation adjustment part (4) is located in front of the rotation driver (2);

the outer frame (6) is located outside the rotation driver (2);

an outer frame upper supporting shoe (7) is located at the back of the outer frame (6), and the propulsion oil cylinders (3) are fixed on the outer frame (6) and the outer frame upper supporting shoe (7), respectively;

a rear support (8) and a water tank (9) are located at the back of the outer frame upper supporting shoe (7), and the rear support (8) is located between the outer frame upper supporting shoe (7) and the water tank (9);

a waterjet external water pipe (10) is provided on the water tank (9), and the water tank (9) and the rock-breaking device (1.1) are connected through the waterjet external water pipe (10);

a transmission conveyor (11) is located inside the outer frame (6);

a bucket (12) is located at a front end of the transmission conveyor (11);

a shield (13) and oil hydraulic cylinders (14) are provided outside the outer frame (6); and two ends of the oil hydraulic cylinders (14) are respectively connected to an outer wall of the outer frame (6) and an inner wall of the shield (13).

9. The method of claim 8, wherein the waterjet rotation adjustment part (4) comprises a high-pressure water pipe docking port (4.1) and a waterjet rotation adjustment part disc (4.2);

the high-pressure water pipe docking port (4.1) is located on the waterjet rotation adjustment part disc (4.2);

an outer periphery of the waterjet rotation adjustment part disc (4.2) is fixed to an inner wall of the rotation driver (2);

the high-pressure water pipe docking port (4.1) comprises a high-pressure water pipe docking port front end (4.11) and a high-pressure water pipe docking port rear end (4.12);

the high-pressure water pipe docking port rear end (4.12) is in communication with the waterjet external water pipe (10);

the high-pressure water pipe docking port front end (4.11) is in communication with the high-pressure water pipe (1.1122); and the waterjet external water pipe (10) is telescopic water pipe.

10. The method of claim 9, wherein:

the TBM cutter head control center responds to the working condition parameters of the parameter information transmitted from the TBM back-end control processor, and acts on the mechanical cutter tools (1.111) and the high-pressure water jet nozzle structures (1.112);

the lithology type and the working condition parameters of the parameter information obtained through the three-way force detection cutter mechanisms (1.12) are finally applied to the TBM propulsion cutter mechanisms (1.11) adjacent to the three-way force detection cutter mechanisms (1.12); and construction work is started after obtaining the working condition parameters of the parameter information at the TBM propulsion cutter mechanisms (1.11) and adjustments adjusting the TBM propulsion cutter mechanisms (1.11) based on the obtained working condition parameters of the parameter information.

* * * * *